US005531166A

United States Patent [19]

Woods et al.

[11] Patent Number: 5,531,166

[45] Date of Patent: Jul. 2, 1996

[54] CORRUGATED FIBERBOARD RISER

[76] Inventors: James L. Woods; Robert F. Thomasino, both of 4120 Brighton Blvd., Unit A-23, Denver, Colo. 80216

[21] Appl. No.: 313,453

[22] Filed: Sep. 27, 1994

[51] Int. Cl.[6] ..... B65D 19/00

[52] U.S. Cl. ..... 108/51.3

[58] Field of Search ..... 108/51.3, 51.1, 108/56.3

[56] References Cited

U.S. PATENT DOCUMENTS

| | | | |
|---|---|---|---|
| 3,026,015 | 3/1962 | Severn | 108/51.3 X |
| 3,167,038 | 1/1965 | Brown | 108/51.3 |
| 3,199,764 | 8/1965 | Oliver et al. | 108/51.3 X |
| 3,464,370 | 9/1969 | Martin | 108/51.3 |
| 3,464,371 | 9/1969 | Gifford . | |
| 3,557,719 | 1/1971 | Gielas | 108/51.3 |
| 3,940,101 | 2/1976 | Heidelbach | 108/51.3 X |
| 3,942,654 | 3/1976 | Warrick . | |
| 4,390,154 | 6/1983 | Ostler et al. . | |
| 4,429,794 | 2/1984 | Steger et al. . | |
| 4,714,026 | 12/1987 | Yamaguchi et al. | 108/51.3 X |
| 4,863,024 | 9/1989 | Booth | 108/51.3 X |
| 4,867,074 | 9/1989 | Quasnick . | |
| 5,076,176 | 12/1991 | Clasen . | |
| 5,129,329 | 7/1992 | Clasen . | |
| 5,156,094 | 10/1992 | Johansson et al. . | |
| 5,218,913 | 6/1993 | Winegarger et al. . | |
| 5,269,219 | 12/1993 | Juvik-Woods . | |
| 5,329,861 | 7/1994 | McCarthy | 108/51.3 |

*Primary Examiner*—Jose V. Chen
*Attorney, Agent, or Firm*—Pittenger & Smith

[57] ABSTRACT

An improved riser for supporting a load in storage or transportation formed from a plurality of elongated, narrow, corrugated fiberboard strips positioned on edge and arranged side by side and adhered together along their contiguous surfaces to form a laminated core member. A sufficient number of strips are laminated together to form a core member having a suitable width to support and space a cargo load above a supporting surface or other vertically stacked loads. The strips forming the laminated core member can have any desired length which is necessary to support the intended loads. The core member can be reinforced by applying one or more lateral bands to reinforce and prevent delamination of the strips. The core member for the riser can be inserted within an elongated box-like cover formed from corrugated fiberboard material to encapsulate and sheath the outside surfaces of the core member. Overlapping end flaps are used to seal the interior of the cover and to protect the core member when the risers are strapped longitudinally to the unitized supported load. The core member and the protective cover can be sealed with a suitable coating to prevent the absorption of moisture or contamination which can degrade the load carrying ability of the riser.

15 Claims, 2 Drawing Sheets

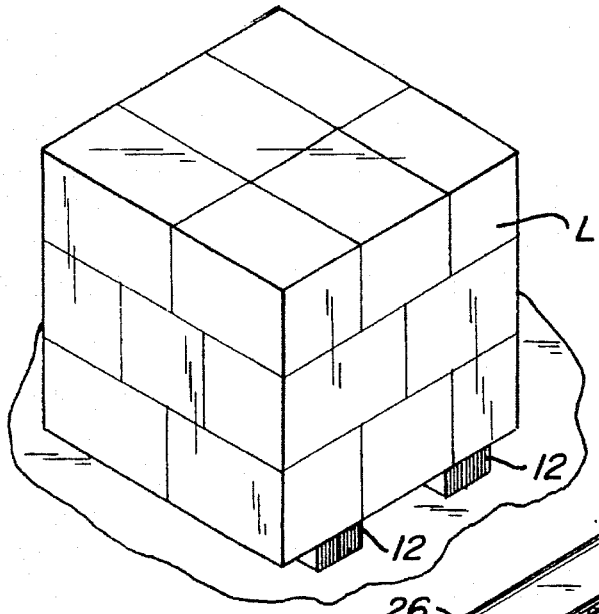
Fig_1
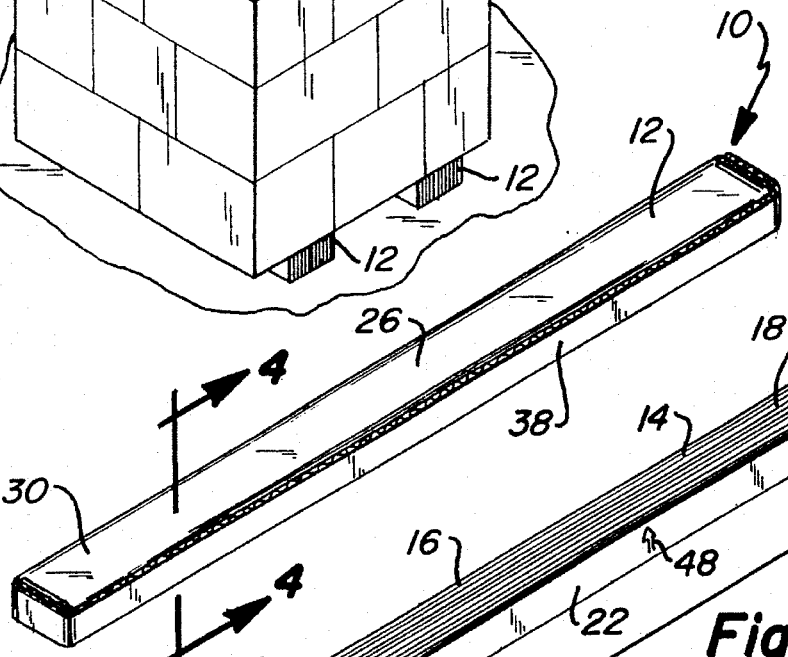
Fig_2
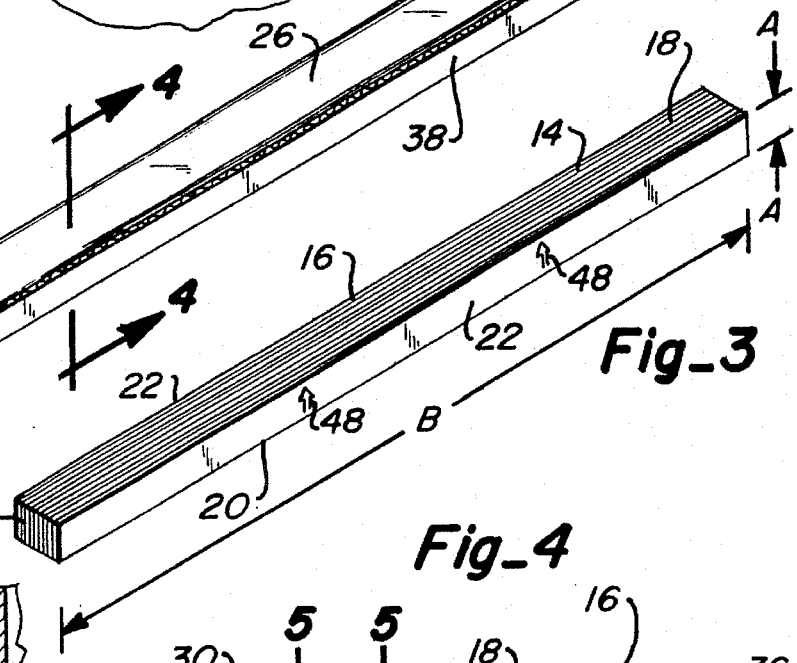
Fig_3
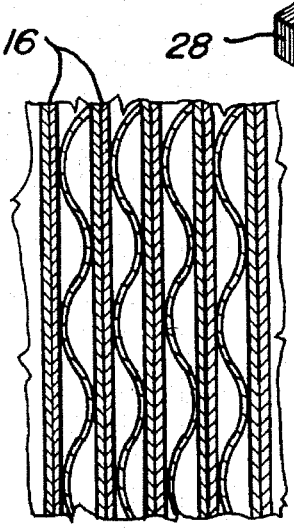
Fig_5
Fig_4
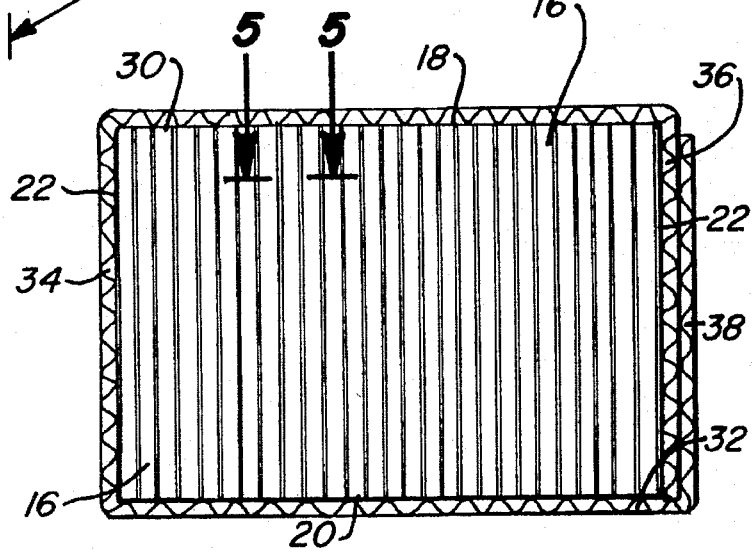

CORRUGATED FIBERBOARD RISER

FIELD OF THE INVENTION

This invention is directed to an improved riser for spacing and separating unitized loads. It is more specifically directed to a corrugated fiberboard riser for supporting and separating commercial cargo type loads during storage and transportation.

SUMMARY OF THE INVENTION

For many years various types of objects have been used to separate and support loads that are stored and transported in stacked arrangement. The equipment that is primarily used for performing this stacking arrangement is a front end loader or forklift truck which raises the individual loads so that they can be stacked one on top of the other. In order to separate the loads from each other, one or more spacers or risers are positioned between the loads so as to allow space for the insertion of the forks of a forklift truck for moving and positioning the loads for warehouse storage or transportation on vehicles.

Up to the present time, common wood planks and more specifically 2"×4" wooden studs have been used as the spacers or risers in stacking loads for transportation and storage purposes. In many cases these 2"×4" studs are common rough cut lumber, which was relatively cheap and readily available. Recently, because of various factors, the cost of lumber has escalated considerably and the availability of this material is becoming increasingly scarce. For these reasons, it is now necessary to provide risers which are fabricated from other materials and which are suitable for supporting the loads, yet which are inexpensive and easily manufactured from available materials.

INFORMATION DISCLOSURE STATEMENT

This information is provided in response to the applicants' acknowledged duty to inform the Patent and Trademark Office of all materials that are pertinent to the examination of this application.

The Juvik-Woods patent (U.S. Pat. No. 5,269,219) discloses a pallet design which includes a plurality of longitudinal runners which are formed with a core of honeycomb material and covered with a sheathing of paper which is adhered to the sides and outer surfaces of the runner. These runners, in turn, are then adhered to an extended flat surface which forms the lower surface of the pallet. It also states that corrugate paperboard can be used to form the core structure of the runners. However, where corrugate sheets are utilized the corrugate sheets are glued together and stacked parallel to the surface of the pallet to give the necessary height requirement for the pallet. In the applicants' invention the risers are separate independent members and are not a part of a pallet structure and utilize corrugate fiberboard or paperboard wherein the corrugations are arranged vertical to greatly enhance the load carrying capability of the riser.

The Johansson et al patent (U.S. Pat. No. 5,156,094) discloses a disposable pallet comprising a baseplate of corrugated cardboard in a plurality of block-shaped feet situated on the bottom side of the baseplate. Each block-shaped foot is made of corrugated cardboard, with the corrugated cardboard situated substantially perpendicular to the baseplate. The corrugations in this patent are arranged similar to those provided in the present invention. The applicants invention, however, is directed to an elongated individual riser which is freely moveable and positionable rather than the simplified pallet structure which is shown in this patent.

The Warrick patent (U.S. Pat. No. 3,942,654) shows an elongated self adhering support for loads which is made up of an elongated foam core which includes a strip of adhesive material along one surface so that this surface can be adhered to a bottom location on the actual load. A plurality of these runners are attached to the load to space the load from either the supporting surface or other stacked loads. This patent discloses an elongated riser type of structure, but the construction disclosed is far removed from the applicants' concept and does not provide the structural integrity that is provided in the present invention.

The Gifford patent (U.S. Pat. No. 3,464,371) discloses a disposable fiberboard pallet having integrally formed runners or legs having a fiberboard core and an outer surrounding cover. The runners formed as part of the integral structure of the overall pallet are not separate and do not teach the novel structural configuration that is shown in the present application.

The Quasnick patent (U.S. Pat. No. 4,867,074) and the Winebarger et al patent (U.S. Pat. No. 5,218,913) show integrally formed pallets which are formed from corrugated fiberboard material. The individual components of these inventions are formed separately and are then assembled into the pallet structure. The elongated runners which form the legs of these pallets are generally formed from folded corrugated fiberboard which are folded back and forth to form the elongated structure. There is no indication in these patents that the individual runners have the structural integrity to be used separately as independent risers as taught in the present invention.

The Clasen patents (U.S. Pat. Nos. 5,076,176 and 5,129,329) both disclose a lightweight pallet structure wherein the individual leg pads are formed from corrugated cardboard which are laminated with the corrugations in various directions. These patents do not teach the use of the elongated runners nor individual runner structures which could form separate risers for load spacing.

The Steger et al patent (U.S. Pat. No. 4,429,794) shows a packaging arrangement including a fabricated tray-like support member which can be fitted to the lower portion of the load. In addition, a top cover can be provided for the load. The tray-like bottom support member is formed from solid fiberboard material. The top cover is also formed from suitable solid fiberboard material. Straps are used to bind the load with the bottom support member and the top cover held properly in position. The strapping material when it is tensioned holds the support member in place and provides a unitized load structure.

SUMMARY OF THE INVENTION

A simplified, load bearing riser is formed for the purpose of elevating and supporting a palletized or unitized load in preparation for storage or transportation. This simplified riser is an elongated member formed from a plurality of individual corrugated fiberboard strips which are sufficiently wide to form the height of the riser and have the length of the overall finished product. These strips are positioned on edge and arranged side by side until the overall width of the riser or spacer is obtained. In some cases, the width of the individual strips can be 1½ to 1¾ inches and the width of the overall finished riser can have approximately 12–14 strips when all of the strips are glued together to form the solid core riser having the approximate outer cross-sectional dimensions of the common 2"×4" wooden stud. The individual corrugations provided in the corrugated fiberboard material extend in the direction of the shorter height dimension of the core. In this way, the compressive strength of the riser core is quite substantial when the loads are applied in the direction of the shorter dimension.

In order to keep the corrugated fiberboard strips from separating or delaminating and thus losing their strength, bands or straps can be provided around the core member to hold the laminations in position during use. In many cases, three (3) bands can be used wherein one is positioned in the middle and the others near either end of the riser. These bands greatly reinforce the strength of the riser and allow for additional load carrying capacity.

It is common practice to band the stacked products together with straps positioned over the ends of the risers to hold the load and risers in a rigid unitized structure. When end banding of the risers is anticipated, blocks can be glued to the ends of the riser to provide cushioning and reinforcing so that the load straps will not cut into the ends of the laminated core. In this configuration the riser can take a considerable load roughly equivalent to that provided by the conventional 2"×4" wooden stud.

In another embodiment which does away with the necessity of the end blocks, an outer cover or sheath is positioned around the stacked corrugated core strips. The outer cover can be formed from a folded sheet of corrugated fiberboard which is folded so as to have the outside dimensions of the finished riser. The folds of the box or sheet are overlapped along one edge and this edge is fastened by use of suitable adhesives. The end flaps of the box are overlapped and these also are fastened and sealed by a suitable adhesive. The overlapping of the flaps at the ends of the risers take the place of the end blocks which have been described above for cushioning and reinforcing the ends of the riser to protect against strapping and damage. It is also undestood that mechanical fasteners , such as staples can be used to assemble and hold the cover in sealed position.

It is also anticipated that the box-like cover can utilize tabs and slots to hold the outer sheath in proper place or the tabs can be glued together to form a one-piece rigid outer sheath. The sheath or cover encases the corrugated strips and holds them rigidly in place while at the same time protecting them from the environment, especially dampness. It is also anticipated that the entire structure can be waterproofed or dampproofed by dipping or coating the core as well as the outer sheath in a suitable waterproofing material, such as wax, plastics, shellac, lacquer or oil base coatings. Both the sheath and the core can be protected or just the sheath by itself. The need for the protection is determined primarily by the location and intended use of the riser.

Where it is anticipated that the riser will be used in high compressive force applications, it is anticipated that the core can also be banded before it is encased within the sheath. The purpose of the outer sheath and bands is to hold the internal core and corrugated strips rigidly in position while at the same time protecting the core from the environment. The outer sheath also provides a better and wider distribution of the compressive forces to the edges of the internal core strips to enhance the ability of the riser to withstand high compressive loads.

The outer dimensions of the finished riser, having just the core or the core and sheath, can have any suitable dimensions for the intended purpose. In many cases, the outer dimension will be roughly the same as that provided by a common 2"×4" or 4"×4" elongated wooden member or stud. These are common dimensions for this type of product. It is anticipated that tradition will dictate that these dimensions will be substantially used in the fabrication of the risers according to the present invention.

The risers according to the present invention can be additionally coated with a fire proof or fire retardant material and the product used in residential and commercial building construction to replace ordinary wooden type studs. In this embodiment, the interior positioning of the corrugated strips within the core member would have to be modified to arrange the corrugations in a longitudinal direction for withstanding compression in that direction. In this embodiment, a 4"×4" or larger cross section may be required for the finished riser to replace a 2"×4" wooden stud.

BRIEF DESCRIPTION OF THE DRAWINGS

The present invention will be better understood by reference to the following detailed description of the preferred embodiment of the invention when taken in conjunction with the drawings wherein:

FIG. 1 is a perspective view showing a palletized load supported by a pair of individual risers according to the present invention;

FIG. 2 is a perspective view showing a riser according to the present invention having an outer protective sheath;

FIG. 3 is a perspective view showing the core structure of a riser according to the present invention;

FIG. 4 is a cross section taken along the lines 4, 4 of FIG. 2;

FIG. 5 is cross section taken along lines 5, 5 of FIG. 4;

DETAILED DESCRIPTION OF THE INVENTION

Figure 6:
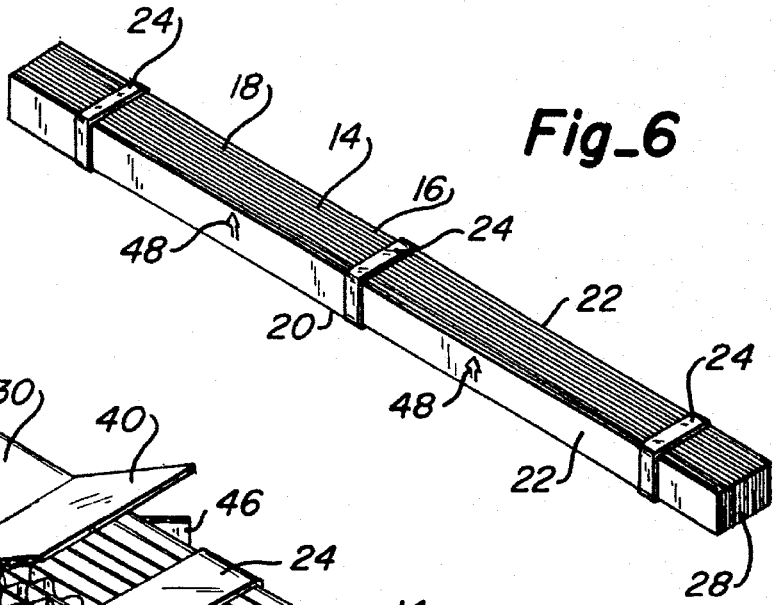
FIG. 6 is a perspective view showing the core member with a plurality of lateral reinforcing bands.

Turning now more specifically to the drawings, FIG. 1 shows a palletized load L which is supported on two spaced, parallel risers 12 according to the present invention. Risers 12 support the load in a stable manner on the support surface and elevates the load above the support surface to allow access by the forks of a forklift truck for loading and unloading the material from a storage area or transportation vehicle. As an extra precaution, the riser can be used to also elevate the load L above the support surface to prevent moisture and contamination from reaching the load.

FIG. 3 shows the core member or section 14 of the riser 12 according to the present invention. The core 14 is made up of a plurality of strips 16 each having a width A and a length B. In order to simulate the dimensions of a common 2"×4" wooden stud, the A dimension is approximately 1¾ inches with the B dimension being any length as desired, to fit the dimensions of the anticipated load L. In most cases, this dimension will be in increments of 2 feet, such as 4', 6' and 8'.

The strip 16 can be fabricated from corrugated fiberboard, cardboard or paperboard depending upon the anticipated strength requirements of the overall finished product. For the sake of illustration in this application reference will be made to the use of corrugated fiberboard. In many cases where high compressive strengths are required, high density corrugated fiberboard is recommended. The strips are positioned side by side and are joined together along their outer flat surface by means of a suitable fastener or adhesive, such as a polyester or other suitable resin. Usually, it is desirable to utilize high strength fasteners or adhesives which are not susceptible to dampness or moisture. By the use of these kinds of fasteners or adhesives, the riser, according to the present invention, can be utilized under adverse environmental conditions. Usually, 12–14 strips 16 are required to provide a width for the riser of approximately 3¾ inches to simulate the 2"×4" common wooden member. The width A of the strip becomes the height of the riser.

Of critical importance to the proper functioning of the riser according to the present invention is the positioning of the corrugations within the corrugated fiberboard which is utilized in making up the individual strips 16. As shown in FIG. 3, the corrugations are arranged parallel to the width which becomes the vertical or height dimension of the riser. In this way, the top 18 and bottom surfaces 20 of the riser 14 are intended as the support surfaces and thus, the longitudinal direction of the corrugations are perpendicular to these surfaces. Positioning the corrugations in this direction provides the maximum compressive strength for the support riser. With the use of a suitable number of strips and the proper adhesive for the intended use, the riser core 14 becomes an integrated member which is not only light-in-weight but has considerable compressive strength when this force is applied to the top 18 and bottom 20 surfaces of the riser.

If desired, arrows can be imprinted on the side surfaces 22 of the riser 14 to indicate to users that the riser is to be positioned with the side surfaces vertical so that the compressive loads will be properly applied.

In order to further reinforce the core member 14, bands or straps 24 may be positioned laterally and circumferentially around the laminated riser 14. The bands 24 can be fabricated from metal or other suitable material, such as polyethylene or polypropylene that can be reinforced with fiber strands, such as fiberglass or nylon threads. The reinforcing bands are tightly applied laterally across the width of the riser 14 and provide the function of reinforcing the laminations to maintain them in proper juxtaposition. The bands help to support the laminations and prevent the separation of the laminations by the application of the compressive loads.

Figure 7:
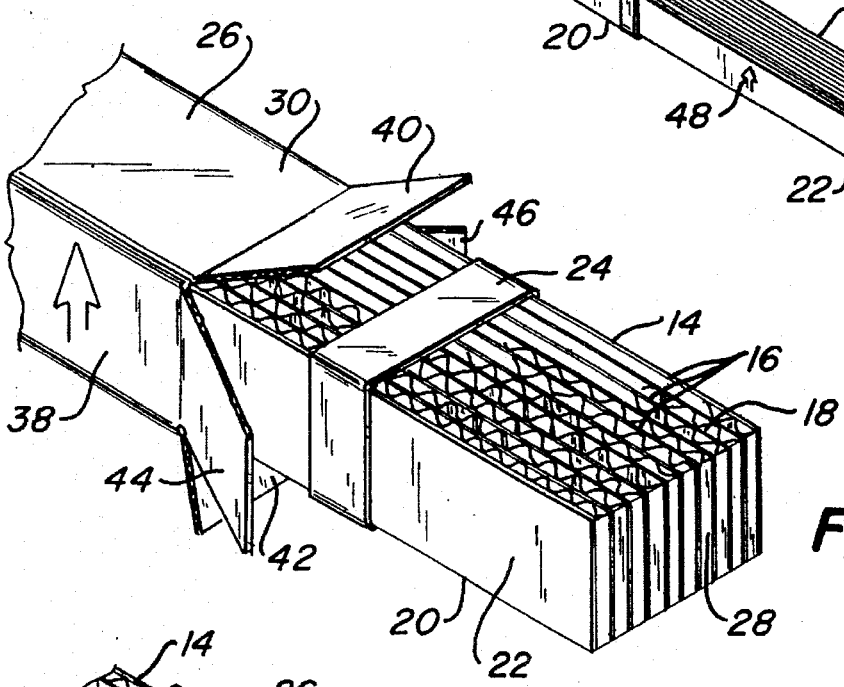
FIG. 7 is a pictorial view showing the core member being inserted into the sheath of the riser.
Figure 8:
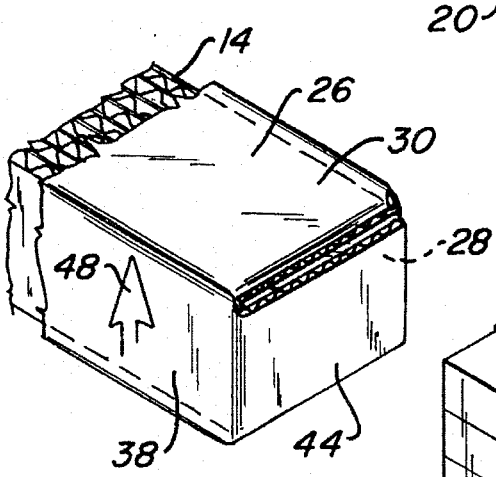
FIG. 8 is a pictorial perspective view showing the ends of the sheath closed to encapsulate the core member.
Figure 9:
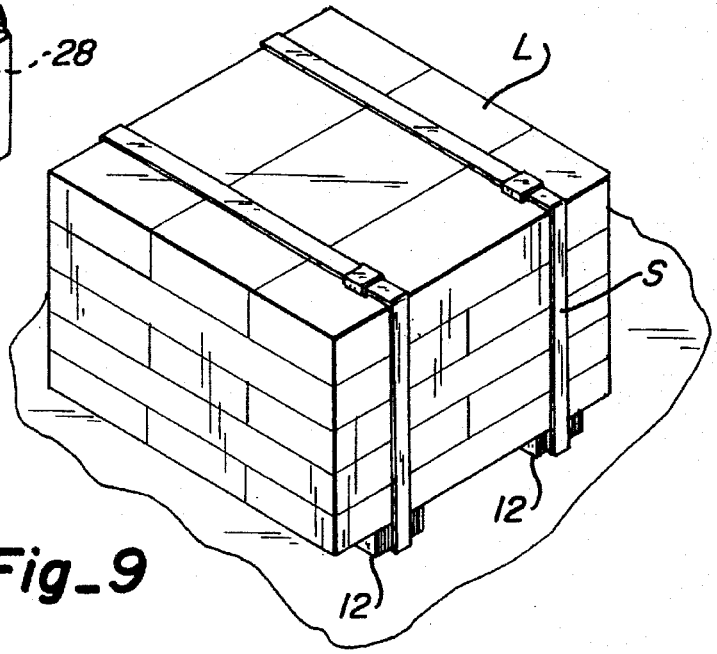
FIG. 9 is a perspective view showing a palletized load supported by a pair of individual risers, each riser securely strapped to the load.

Another embodiment of the riser 12 according to the present invention is shown in FIG. 2. In order to protect the riser core 14 not only from separation of the laminations but also from impact and environmental damage, such as rain and snow, an outer sheath or cover 26 can be provided. The elongated cover 26 can be formed from an elongated sheet of material, such as corrugated fiberboard and folded along fold lines so as to form a top surface 30, side surface 34, bottom surface 32, and overlapping flap members 36, 38 which form the opposite side from side surface 34. The dimensions of each of the surfaces of the cover are maintained to closely fit the outer dimensions of the core member 14. In this way, the outer sheath or cover 26 can closely conform to the cross section and dimensions of the core member 14 to aid in holding the laminations in proper position during use as well as helping to distribute the compressive loads equally across the edges of the strips 16 so that specific load concentrations will be minimized on the top and bottom surfaces 16, 18 of the core member 14. As shown in FIGS. 7, the core member 14 when inserted within the cover 26 can also include the bands 24 to further reinforce the overall structure.

In completing the cover 26, the side flap members 36, 38 are joined together by a suitable adhesive or fasteners. If desired, the outside dimensions of the core member 14 can be slightly reduced to compensate for the thickness of the cover 26 so that the overall outside dimension of the riser will still approximate the finished dimensions of the standard 2"×4" wooden member. It is also to be understood that flap members 36, 38 can be rearranged so that they correspond as the top or bottom of the cover 26 in order to provide additional cushioning for the areas that will be subjected to the compressive loads. In addition, it is also possible to form the outer cover 26 as a double or multiple layered box where each side and the top and bottom have an added thickness of corrugated fiberboard to provide additional cushioning for the compressive loads.

The ends of the cover 26 are closed and sealed by means of a plurality of foldable flap members 40, 42, 44 and 46 respectively. It is anticipated that these flap members will each have the same dimensions as the overall interior cross-section of the sheath or cover 26. The end flaps 40–46 provide two functions. The first is to provide a means for totally sealing the ends of the cover 26 to encapsulate and protect the core member 14 within the interior of the cover 26. The second is to provide a plurality of layers of corrugated fiberboard over the ends 28 of the core member 14 to protect the ends of the core member against any binding straps S which are used to bind the riser 12 firmly to the load L so as to position and hold the risers 12 in rigid position with respect to the load L. The straps S have a tendency to cut into the ends of the laminated strips 16 and cause separation of the laminations and thus, premature failure of the core member 14. The end flaps 40–46 can be held in position by use of adhesives, staples or any other type of fastener which will hold the end flaps in a closed position.

As discussed earlier, arrows can be imprinted on the outer surface of the cover 26 so as to indicate the proper positioning of the riser 12 during use to maintain the greatest compressive load strength. Although throughout this application reference has been made to the sizing of the riser to approximate the dimensions of a 2"×4" wooden member or stud, it is also possible to increase or decrease the overall dimensions of the finished riser where more or less space is required between the load and the supporting surface. It is understood that where the height of the overall riser 12 is increased substantially, the overall density and strength of the corrugated fiberboard that is used will be increased to provide additional compressive strength and stability in the overall final product.

The riser 12 according to the present invention can be a disposable product, but it is more desirable to provide a product that can be reused a number of times.- In order to accomplish this, it is desirable to seal and encapsulate the riser so that it becomes impervious to water and moisture. Thus, the laminated core member 14 can be sealed by dipping or pressure coating the core member with a suitable sealant material, such as a wax coating, a polyurethane resin or a shellac type coating. The corrugated fiberboard making up the outer cover can also be sealed by the same type of material either before or after it is assembled and before or after receiving the core member 14. In addition, once the end flaps have been closed the entire outer cover can be sealed and coated as a unit.

Although a new and novel riser for spacing and supporting transportable loads has been shown and described in this application, it is to be understood that any modifications or changes in the overall configuration or structure of the described riser is considered to come within the scope of the appended claims.

We claim:

1. An improved lightweight load carrying riser for supporting a load spaced above a supporting surface, said riser comprising:

(a) a plurality of elongated flat strips having width and length dimensions and formed from a corrugated material, the corrugations of said material being arranged parallel to the width dimension of said strip;

(b) said strips being arranged side by side to each other and permanently fastened together with a suitable adhesive to form an elongated, laminated core member, a sufficient number of strips being used to form a laminated core member having a predetermined core width to form top and bottom supporting surfaces;

(c) an outer cover to encapsulate said core member, said outer cover being formed from a sheet-like material which is formed to correspond to the outside dimensions of the core member and completely enclose said core member in order to protect and distribute the forces across the core member; and (d) said core member is reinforced with one or more lateral bands wrapped around the core member so as to prevent the separation of the strips causing delamination and loss of compressive strength in the core member.

2. A riser as defined in claim 1 wherein the adhesive is a waterproof adhesive.

3. A riser as defined in claim 1 wherein the width and length dimensions of the strips are identical.

4. A riser as defined in claim 1 wherein the corrugated material which is used to form the individual strips is a fiberboard material.

5. A riser as defined in claim 1 wherein the corrugated material which is used to form the individual strips is a cardboard material.

6. A riser as defined in claim 1 wherein the corrugated material which is used to form the individual strips is a paperboard material.

7. A riser as defined in claim 1 wherein the core member is coated with a waterproof material which seals the corrugated material to prevent the absorption of water or other liquids which can cause the reduction of the load carrying capacity of the core member.

8. A riser as defined in claim 1 wherein the outer cover is formed from a corrugated material,

9. A riser as defined in claim 8 wherein the corrugated material is folded from a single one-piece sheet along fold lines so as to form ends, sides, top and bottom portions which correspond to the dimensions of the outer surfaces of said core member.

10. A riser as defined in claim 9 wherein the outer cover wherein the end portions are opposing and are formed from a plurality of flaps which are folded over each other so as to close and seal the interior of said cover.

11. A riser-as defined in claim 1 wherein the inside dimensions of the cover closely match the outside dimensions of the core member so that the cover and core member closely fit whereby compressive forces applied to the cover are evenly transferred to the edges of the strips making up the core member.

12. A riser as defined in claim 1 wherein the coating is a waterproof sealant to aid in preventing moisture from penetrating and weakening the core member.

13. A riser as defined in claim 1 wherein the cover includes a plurality of end flaps on each end of the riser, said end flaps are positioned to overlap each other and are permanently fastened in a closed position so as to protect and cushion the ends of the core member.

14. A riser as defined in claim 1 wherein the core member is coated with a water repellent material so as to prevent moisture or liquids from being absorbed into the strips of the core material which in turn can weaken the load carrying ability of the core member.

15. A lightweight, individual, load carrying riser for supporting a cargo load spaced above a supporting surface, a plurality of said risers being positioned substantially parallel to support said cargo load and allow positioning of the forks of a forklift truck so as to move and vertically stack said cargo load, said lightweight riser comprising:

(a) a plurality of elongated, flat strips having a width and a length dimension and formed from a corrugated material, the corrugations of said material being arranged parallel to the width dimension of each of said strips;

(b) said strips being arranged in a side by side relation to each other and permanently fastened together with a suitable waterproof adhesive to form an elongated laminated core member, a sufficient number of strips being used wherein the width of the core member forms relatively wide top and bottom load bearing surfaces which are perpendicular to the corrugations of said strips, said core member being reinforced by one or more lateral bands wrapped around the core member so as to prevent delamination of the strips making up the core member;

(c) a cover means formed from a single sheet-like material, said material having longitudinal fold lines which are folded to form inside surfaces which match the outer surfaces of the core member in a box-like structure which will closely fit the core member placed internally within the cover means, the box-like structure having end portions formed from overlapping flaps which are permanently joined by a suitable adhesive so as to protect and cushion the ends of the core member; and (d) said cover means being coated with a suitable waterproof material so as to prevent the absorption of moisture by the cover means and core member to prevent deterioration of said core member.

* * * * *

UNITED STATES PATENT AND TRADEMARK OFFICE
CERTIFICATE OF CORRECTION

PATENT NO. : 5,531,166

DATED : July 2, 1996

INVENTOR(S) : James L. Woods and Robert F. Thomasino

It is certified that error appears in the above-identified patent and that said Letters Patent is hereby corrected as shown below:

In Claim 1, line 14, change "encapsulate" to --enclose--;
In line 17, change "completely enclose" to --cover--.

In Claim 10, line 1 delete "wherein the outer cover".

Signed and Sealed this

First Day of July, 1997

Bruce Lehman

*Attest:*

BRUCE LEHMAN

*Attesting Officer*

*Commissioner of Patents and Trademarks*